US008733878B2

(12) United States Patent
Uchino

(10) Patent No.: US 8,733,878 B2
(45) Date of Patent: May 27, 2014

(54) LIQUID DISCHARGER AND IMAGE FORMING APPARATUS HAVING THE SAME

(75) Inventor: Shunji Uchino, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 32 days.

(21) Appl. No.: 13/216,879

(22) Filed: Aug. 24, 2011

(65) Prior Publication Data

US 2012/0050367 A1 Mar. 1, 2012

(30) Foreign Application Priority Data

Aug. 31, 2010 (JP) ..... 2010-194808

(51) Int. Cl.
*B41J 29/38* (2006.01)

(52) U.S. Cl.
USPC ..... 347/16; 347/14

(58) Field of Classification Search
USPC ..... 347/14, 16
See application file for complete search history.

(56) References Cited

U.S. PATENT DOCUMENTS 5,237,344 A * 8/1993 Tasaki et al. ..... 347/9
6,341,854 B1 1/2002 Takemoto
6,471,315 B1 10/2002 Kurata
6,910,752 B2 * 6/2005 Shoji ..... 347/14
2004/0080596 A1 * 4/2004 Taguchi et al. ..... 347/100
2007/0103534 A1 * 5/2007 Shinohara et al. ..... 347/104

FOREIGN PATENT DOCUMENTS

JP H11-240146 A 9/1999
JP 2000-037942 A 2/2000
JP 2010-082935 A 4/2010

OTHER PUBLICATIONS

Japan Patent Office, Notification of Reasons for Rejection for Japanese Patent Application No. 2010-194808 (related to above-captioned patent application), mailed Jan. 7, 2014.

* cited by examiner

*Primary Examiner* — Alessandro Amari
*Assistant Examiner* — Carlos A Martinez
(74) *Attorney, Agent, or Firm* — Baker Botts L.L.P.

(57) ABSTRACT

A liquid discharger is provided that includes a sheet detector, a second discharging head discharging second liquid, a rotary roller, and a first discharging head discharging first liquid disposed in the above order from an upstream side in a feeding direction. The liquid discharger further includes an arrival time storing unit storing a standard arrival time for the predetermined position of a sheet to reach the first discharging head from the sheet detector when there is no second liquid attaching onto the rotary roller, a delay time storing unit storing a relationship between a attachment amount and a delay time, a delay time determining unit determining a delay time corresponding to a determined attachment amount based on the relationship, and a controller determining a moment when the first discharging head is to discharge the first liquid based on the stored standard arrival time and the determined delay time.

20 Claims, 5 Drawing Sheets

LIQUID DISCHARGER AND IMAGE FORMING APPARATUS HAVING THE SAME

CROSS-REFERENCE TO RELATED APPLICATION

This application claims priority under 35 U.S.C. §119 from Japanese Patent Application No. 2010-194808 filed on Aug. 31, 2010. The entire subject matter of the application is incorporated herein by reference.

BACKGROUND

1. Technical Field

The following description relates to one or more techniques to, prior to discharging a droplet of first liquid, discharge onto a recording medium second liquid for agglutinating or precipitating one or more components contained in the first liquid.

2. Related Art

An inkjet printer has been known, which is configured to, prior to discharging a droplet of ink to form a dot onto a sheet, discharge pretreatment liquid for agglutinating or precipitating one or more coloring components contained in the ink, onto an area where the dot is to be formed, in order to restrain bleeding of the dot on the sheet. For the inkjet printer, a technique has been known that is to press and spread the discharged pretreatment liquid with a pressing roller after the pretreatment liquid is discharged onto the area of the sheet where the dot is to be formed.

SUMMARY

In the aforementioned technique, when a leading end of the conveyed sheet collides against the pressing roller, the sheet might be bent and slip on the pressing roller, and thereby it might cause delay relative to an estimated sheet feeding time to be taken for feeding the sheet to an inkjet head. When the delay is caused relative to the estimated sheet feeding time, the sheet reaches the inkjet head late by the delay. Hence, when a droplet of ink is discharged at a moment originally set based on the estimated sheet feeding time, the droplet of ink lands in a different position from a desired position (in which the droplet of ink is to land) on the sheet, and it leads to a low level of printing quality. To avoid such a situation, the position of the sheet between the pressing roller and the inkjet head may be detected by a sensor, so as to correct a time difference between a desired moment and the originally set moment when the droplet of ink is to be discharged. However, the incorporation of the sensor results in increased size and cost of the inkjet printer.

Aspects of the present invention are advantageous to provide one or more improved techniques that make it possible to exactly correct a moment for a liquid discharger to discharge first liquid, which is to be discharged later than second liquid for agglutinating or precipitating one or more components contained in the first liquid.

According to aspects of the present invention, a liquid discharger is provided, which includes a feeding mechanism configured to feed a sheet in a feeding direction along a feeding path, a first discharging head configured to discharge, onto a predetermined side of the sheet being fed in the feeding direction, first liquid for forming an image on the sheet, a second discharging head disposed upstream relative to the first discharging head in the feeding direction, the second discharging head being configured to discharge, onto the predetermined side of the sheet being fed in the feeding direction, second liquid that acts on the first liquid to agglutinate or precipitate a component contained in the first liquid, a detector disposed upstream relative to the second discharging head in the feeding direction, the detector being configured to detect that a predetermined position of the sheet passes through a detecting point for the detector on the feeding path, a rotary roller disposed upstream relative to the first discharging head and downstream relative to the second discharging head in the feeding direction, the rotary roller being configured to contact the predetermined side of the sheet being fed in the feeding direction, an attachment amount determining unit configured to determine an attachment amount of the second liquid attaching onto the rotary roller via the sheet after being discharged by the second discharging head, based on an amount of the second liquid discharged by the second discharging head, an arrival time storing unit configured to store a standard arrival time that is a time period required for the sheet to reach the first discharging head since the detector detects that the predetermined position of the sheet being fed at a predetermined feeding velocity passes through the detection point in a state where there is no second liquid attaching onto the rotary roller, a delay time storing unit configured to store a relationship between each value of the attachment amount and a corresponding delay time to be caused when the sheet being fed at the predetermined feeding velocity passes through the rotary roller, a delay time determining unit configured to, when the attachment amount determined by the attachment amount determining unit is more than zero, determine a delay time corresponding to the determined attachment amount based on the relationship stored in the delay time storing unit, and a controller configured to control the first discharging head and the second discharging head, the controller determining a moment when the first discharging head is to discharge the first liquid, based on a summation of the standard arrival time stored in the arrival time storing unit and the delay time determined by the delay time determining unit.

According to aspects of the present invention, further provided is an image forming apparatus configured to form an image on a sheet while discharging first liquid onto the sheet. The image forming apparatus includes a liquid discharger that includes a feeding mechanism configured to feed the sheet in a feeding direction along a feeding path, a first discharging head configured to discharge the first liquid onto a predetermined side of the sheet being fed in the feeding direction, a second discharging head disposed upstream relative to the first discharging head in the feeding direction, the second discharging head being configured to discharge, onto the predetermined side of the sheet being fed in the feeding direction, second liquid that acts on the first liquid to agglutinate or precipitate a component contained in the first liquid, a detector disposed upstream relative to the second discharging head in the feeding direction, the detector being configured to detect that a predetermined position of the sheet passes through a detecting point for the detector on the feeding path, a rotary roller disposed upstream relative to the first discharging head and downstream relative to the second discharging head in the feeding direction, the rotary roller being configured to contact the predetermined side of the sheet being fed in the feeding direction, an attachment amount determining unit configured to determine an attachment amount of the second liquid attaching onto the rotary roller via the sheet after being discharged by the second discharging head, based on an amount of the second liquid discharged by the second discharging head, an arrival time storing unit configured to store a standard arrival time that is a time period required for the sheet to reach the first discharging head since the detector detects that the predetermined position of the sheet being fed at a predetermined feeding velocity passes through the detection point in a state where there is no second liquid attaching onto the rotary roller, a delay time storing unit configured to store a relationship between each value of the attachment amount and a corresponding delay time to be caused when the sheet being fed at the predetermined feeding velocity passes through the rotary roller, a delay time determining unit configured to, when the attachment amount determined by the attachment amount determining unit is more than zero, determine a delay time corresponding to the determined attachment amount based on the relationship stored in the delay time storing unit, and a controller configured to control the first discharging head and the second discharging head, the controller determining a moment when the first discharging head is to discharge the first liquid, based on a summation of the standard arrival time stored in the arrival time storing unit and the delay time determined by the delay time determining unit.

BRIEF DESCRIPTION OF THE ACCOMPANYING DRAWINGS

Figure 3:
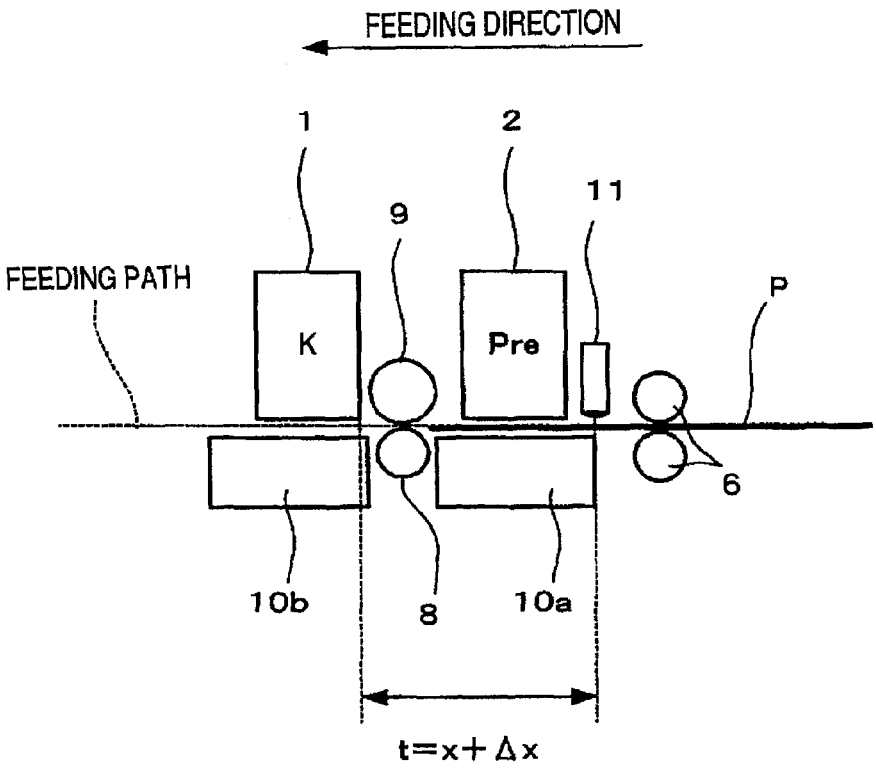

FIG. 3 schematically illustrates a state of a sheet being conveyed by a feeding unit in the embodiment according to one or more aspects of the present invention.

Figure 4:
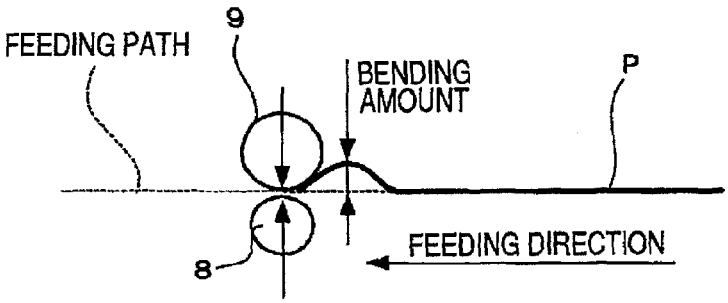

FIG. 4 schematically illustrates a state where the sheet collides against a pressing roller in the embodiment according to one or more aspects of the present invention.

Figure 5:
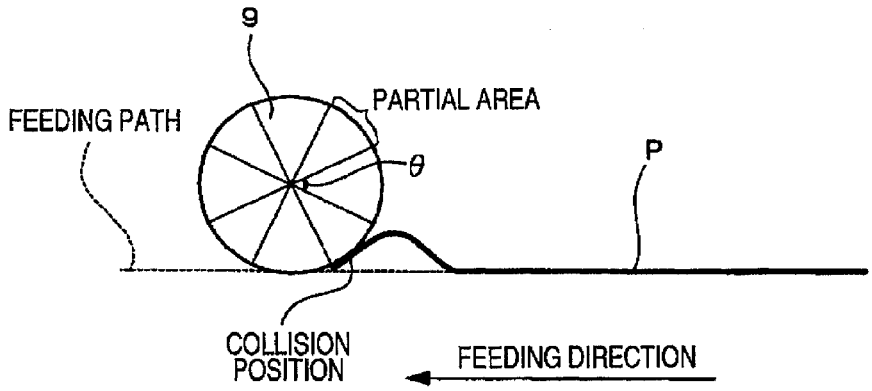

FIG. 5 is an illustration for explaining how an attaching precoat amount determining unit operates in the embodiment according to one or more aspects of the present invention.

Figure 6:
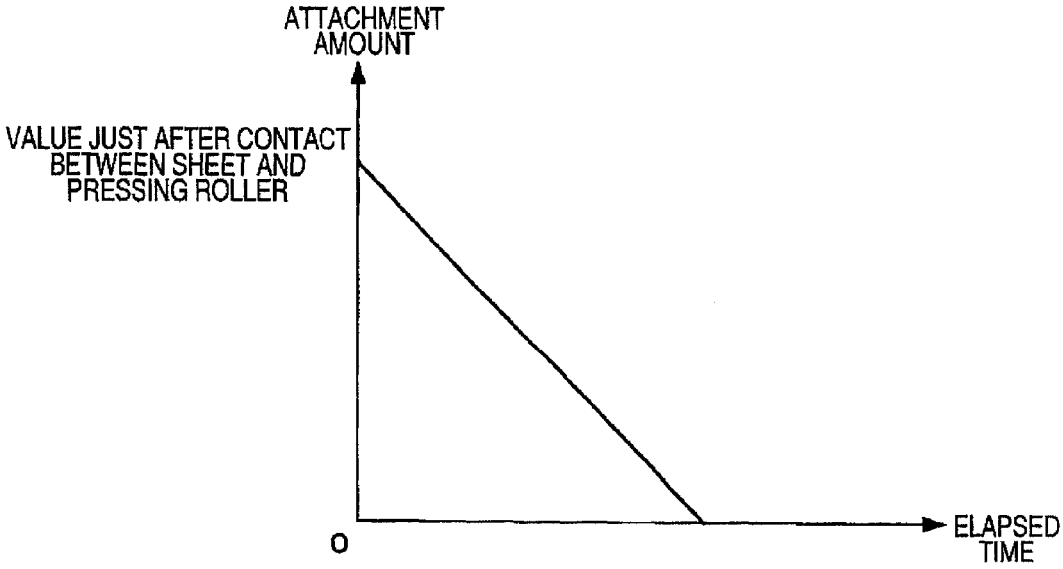

FIG. 6 is a graph showing a relationship between a delay time and an elapsed time since the last contact of the pressing roller with the sheet onto which precoat liquid is discharged in the embodiment according to one or more aspects of the present invention.

Figure 7:
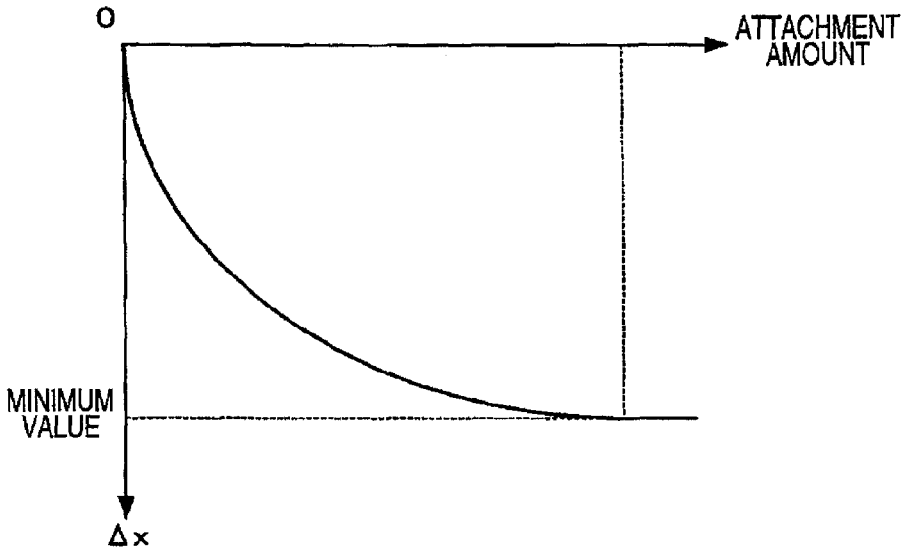

FIG. 7 is a graph showing a relationship between the delay time and the amount of the precoat liquid attaching onto the outer circumferential surface of the pressing roller in the embodiment according to one or more aspects of the present invention.

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the present invention will be described with reference to the accompanying drawings.

Figure 1:
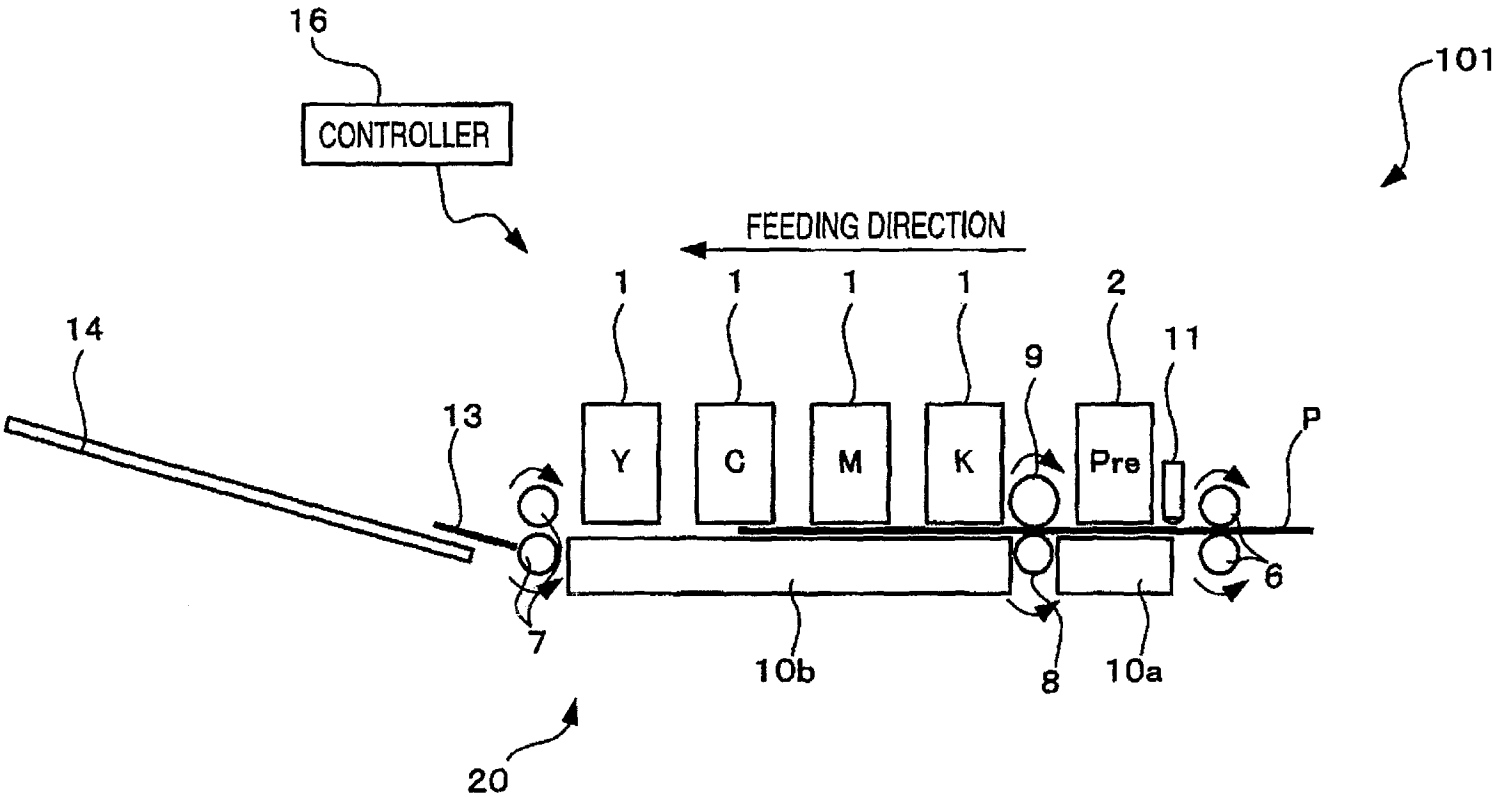
FIG. 1 is a side view schematically showing a configuration of an inkjet printer in an embodiment according to one or more aspects of the present invention.

As shown in FIG. 1, an inkjet printer 101 includes a feeding unit 20 configured to feed a sheet P, four inkjet heads 1 configured to discharge ink droplets of respective colors black (K), magenta (M), cyan (C), and yellow (Y), a precoat head 2 configured to discharge a droplet of precoat liquid (Pre) for agglutinating or precipitating a coloring component of each color of ink, a sheet sensor 11, and a controller 16 configured to control the inkjet printer 101 as a whole. It is noted that in the embodiment, an auxiliary scanning direction is a direction parallel to a feeding direction in which the feeding unit 20 feeds the sheet P, and a main scanning direction is a direction that is perpendicular to the auxiliary scanning direction and along a horizontal plane. Further, precoat liquid for agglutinating a pigment coloring component is applied to pigment ink, and precoat liquid for precipitating a dye coloring component is applied to dye ink. As material for the precoat liquid, for instance, liquid containing polyvalent metal salt such as cationic polymer and magnesium salt may be selectable as needed. When a droplet of ink lands in an area on the sheet P where the precoat liquid has previously been applied, the polyvalent metal salt acts on the coloring component (pigment or dye) of the ink such that insoluble or hardly-soluble metallic complex is formed with the coloring component being agglutinated or precipitated. It results in a reduced degree of penetration of the ink into the sheet P. Thus, it is possible to easily fix the ink onto the sheet P.

The four inkjet heads 1 and the precoat head 2 are configured in the same manner. The four inkjet heads 1 and the precoat head 2 extend in their longitudinal directions along the main scanning direction, respectively, and are arranged in the auxiliary scanning direction to be parallel to each other. The precoat head 2 is disposed upstream relative to the inkjet heads 1 in the feeding direction. Each of the four inkjet heads 1 and the precoat head 2 has a lower face configured as a discharge surface. Namely, the inkjet printer 101 is a line-type inkjet printer.

The feeding unit 20 is a feeding mechanism configured to feed the sheet P along the feeding direction (heading for the left side from the right side in FIG. 1). The feeding unit 20 includes platens 10*a* and 10*b*, a pair of pickup rollers 6, a pressing roller 9, a supporting roller 8, a pair of ejection rollers 7, a separation plate 13, and a catch tray 14. The platen 10*a* is disposed to face the precoat head 2 across a feeding path for the sheet P. The platen 10*b* is disposed to face the four inkjet heads 1 across the feeding path. The platens 10*a* and 10*b* support the sheet P being conveyed, from beneath. There is a predetermined distance of gap, suitable for image formation, formed between upper faces of the platens 10*a* and 10*b* and the discharge surfaces of the four inkjet head 1 and the precoat head 2.

The pickup rollers 6 are disposed upstream relative to the precoat head 2 in the feeding direction. The two pickup rollers 6 are configured to feed the sheet P in the feeding direction when rotating in respective different directions while pinching the sheet P supplied from a sheet feeding unit (not shown).

The pressing roller 9 is disposed between the precoat head 2 and the four inkjet heads 1 (i.e., downstream relative to the precoat head 2 and upstream relative to the four inkjet heads 1) in the feeding direction. Further, the pressing roller 9 is disposed to contact a printed surface (an upper-facing surface in FIG. 1) of the sheet P on which a droplet of the precoat liquid lands. The supporting roller 8 is disposed to face the pressing roller 9 across the feeding path. The pressing roller 9 and the supporting roller 8 are urged by an urging mechanism (not shown) to get close to each other (see FIG. 4). The pressing roller 9 and the supporting roller 8 are configured to further convey the sheet P in the feeding direction when rotating in respective different directions (see arrows in FIG. 1) while pinching the sheet P fed by the pickup rollers 6. At this time, the outer circumferential surface of the pressing roller 9 contacts the printed surface of the sheet P. Thereby, the droplet of the precoat liquid discharged onto the printed surface of the sheet P is pressed and spread by the pressing roller 9, so as to have the precoat liquid of an even thickness over the printed surface of the sheet P. Near the pressing roller 9, a humidity sensor 12 configured to detect humidity around the pressing roller 9 is disposed.

The ejection rollers 7 are disposed downstream relative to the four inkjet heads 1 in the feeding direction. The ejection rollers 7 are configured to further convey the sheet P in the feeding direction when rotating in respective different directions (see arrows in FIG. 1) while pinching the sheet P, with a droplet of ink discharged thereon from each inkjet head 1, fed by the pressing roller 9 and the supporting roller 8.

The separation plate 13 is disposed downstream relative to the ejection rollers 7 in the feeding direction. The separation plate 13 is configured to separate the sheet P from the outer circumferential surfaces of the ejection rollers 7. The catch tray 14 is configured to receive the sheet P separated from the outer circumferential surfaces of the ejection rollers 7 by the separation plate 13.

Thus, the sheet P conveyed in the feeding direction by the feeding unit 20 sequentially passes under the precoat head 2 and the four inkjet heads 1, and thereafter is ejected onto the catch tray 14. When the sheet P passes just beneath the precoat head 2, a droplet of the precoat liquid is discharged by the precoat head 2 so as to be applied onto an area, on the printed surface of the sheet P, in which an image is to be formed. After that, the precoat liquid applied onto the sheet P is pressed and spread by the pressing roller 9. Further, when the sheet P passes just beneath the four inkjet heads 1, an ink droplet of each color is sequentially discharged into the area on the printed surface of the sheet P into which the precoat liquid has been applied, by a corresponding one of the four inkjet heads 1. Thereby, a desired color image is formed on the sheet P. At this time, when the ink droplet lands on the precoat liquid applied onto the sheet P, the precoat liquid agglutinates or precipitates a coloring component contained in the ink droplet, and therefore it is possible to prevent bleeding of the ink on the sheet P.

The sheet sensor 11 is disposed between the pickup rollers 6 and the precoat head 2 (i.e., downstream relative to the pickup rollers 6 and upstream relative to the precoat head 2) in the feeding direction. The sheet sensor 11 is configured to detect a leading end or a trailing end, of the sheet P in the feeding direction, which is passing beneath the sheet sensor 11 after fed by the pickup rollers 6.

Figure 2:
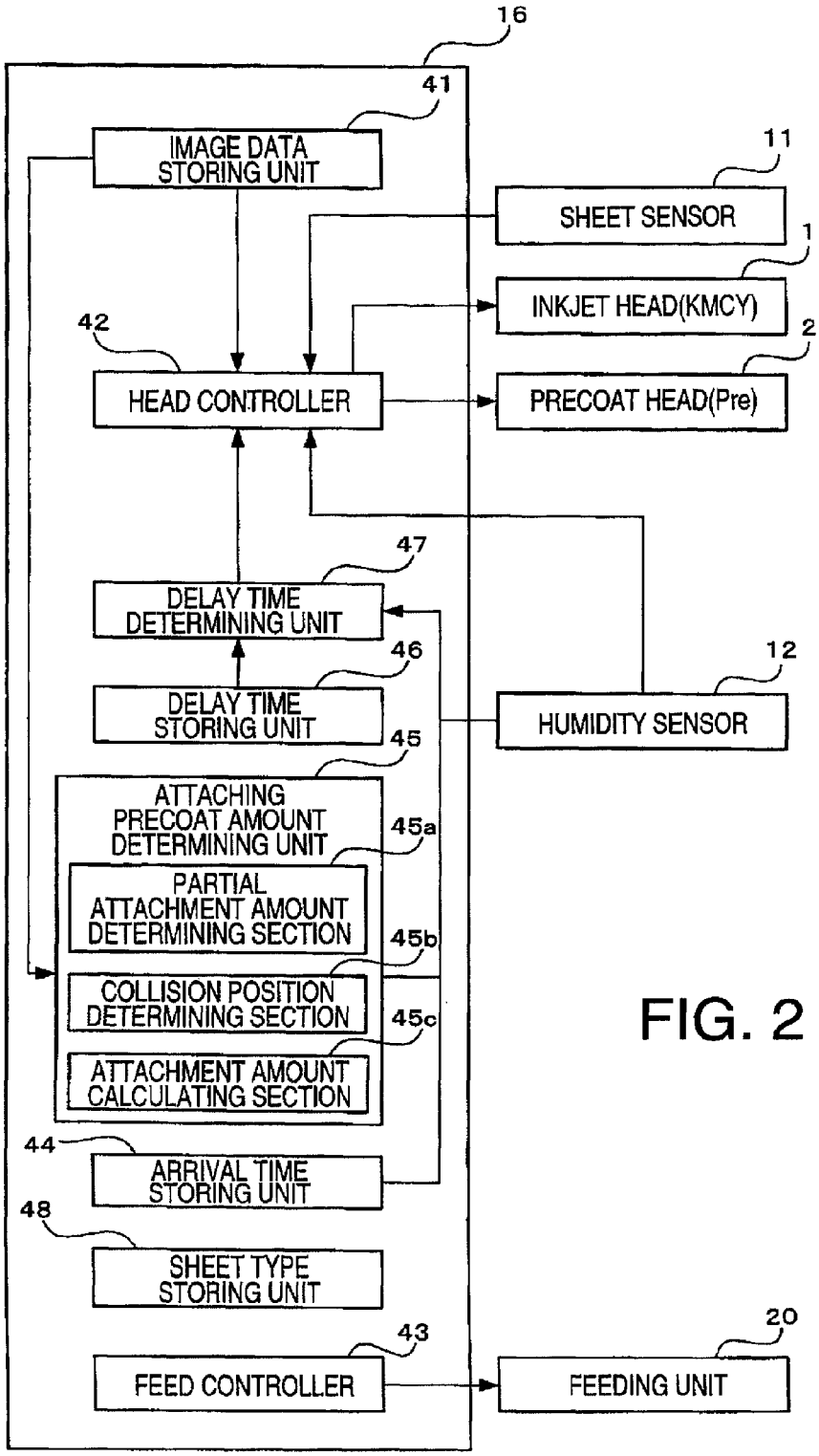
FIG. 2 is a functional block diagram of a controller for the inkjet printer in the embodiment according to one or more aspects of the present invention.

Subsequently, the controller 16 will be described with reference to FIG. 2. The controller 16 includes a central processing unit (CPU), an electrically erasable and programmable read only memory (EEPROM) configured to store programs to be executed by the CPU and data to be used for the programs in a rewritable manner, and a random access memory (RAM) configured to temporarily store data when a program is executed. Each functional element (unit) included in the controller 16 is established by cooperation between hardware such as the CPU, the EEPROM, and the RAM and software stored in the EEPROM. As shown in FIG. 2, the controller 16, which controls the whole inkjet printer 101, includes an image data storing unit 41, a feed controller 43, an arrival time storing unit 44, an attaching precoat amount determining unit 45, a delay time storing unit 46, a sheet type storing unit 48, a delay time determining unit 47, and a head controller 42.

The image data storing unit 41 is configured to store image data for an image to be printed on the sheet P. The image data has density values of the ink of each color (black, cyan, magenta, and yellow) and the precoat liquid, for each of a plurality of pixels corresponding to an image resolution, which pixels are elements into which the sheet P is sectioned along the feeding direction and the main scanning direction. Each density value is quantized into four values, "no discharge," "small-sized droplet," "middle-sized droplet," and "large-sized droplet."

The feed controller 43 controls the feeding unit 20 to feed the sheet P at a desired feeding velocity along the feeding direction.

As illustrated in FIGS. 3 and 4, since the pressing roller 9 and the supporting roller 8 are urged to get close to each other, the leading end of the sheet P fed by the pickup rollers 6 collides against the outer circumferential surface of the pressing roller 9 after passing beneath the sheet sensor 11. At this time, after the leading end of the sheet P is curled by the collision, the sheet P is inserted between the pressing roller 9 and the supporting roller 8 while slipping relative to the pressing roller 9. Thereby, an arrival time t is rendered longer by a delay time. It is noted that the arrival time t is a time period from a time when the leading end of the sheet fed by the feeding unit in the feeding direction is detected by the sheet sensor 11 to a time when the leading end of the sheet reaches a position facing the inkjet head 1 for black that is located upstream in the feeding direction relative to any other inkjet heads 1.

Accordingly, as a slip amount of the sheet P slipping relative to the pressing roller 9 rises, the delay time of the arrival time t becomes longer. The slip amount is determined by factors such as the feeding velocity and thickness of the sheet P, and a frictional force between the sheet P and the pressing roller 9. As the feeding velocity of the sheet P becomes higher, the thickness of the sheet P becomes larger, or the frictional force between the sheet P and the pressing roller 9 becomes smaller, the slip amount becomes larger. Further, the frictional force between the sheet P and the pressing roller 9 is determined by factors such as a pressing force of the pressing roller 9, material of the sheet P, the humidity around the pressing roller 9, and an amount of the precoat liquid attaching onto the outer circumferential surface of the pressing roller 9. For example, as the humidity around the pressing roller 9 becomes higher, or the amount of the precoat liquid attaching onto the outer circumferential surface of the pressing roller 9 becomes larger, the frictional force between the sheet P and the pressing roller 9 becomes higher (the slip amount becomes smaller). In the embodiment, the pressing force of the pressing roller 9 is determined as a value specific to the inkjet printer 101. However, the pressing force of the pressing roller 9 may be adjustable.

The arrival time t is a summation of a standard time x and a delay time $\Delta x$. The standard time x is an arrival time t under an assumption that there is no precoat liquid attaching onto the outer circumferential surface of the pressing roller 9. The delay time $\Delta x$ is a delay time, relative to the standard time x, which is caused by the precoat liquid attaching onto the outer circumferential surface of the pressing roller 9.

The arrival time storing unit 44 stores a (correspondence) relationship between the standard time x and each of combinations of respective values of the feeding velocity of the sheet P, the thickness of the sheet P, the material (type) of the sheet P, and the humidity around the pressing roller 9. Specifically, the arrival time storing unit 44 stores a (correspondence) relationship between the standard time x and each combination of the above values, which relationship is adapted such that the standard time x becomes shorter as the feeding velocity of the sheet P becomes higher, the standard time x becomes longer as the thickness of the sheet P becomes larger, the standard time x becomes longer as the frictional force resulting from the material of the sheet P becomes smaller, and the standard time x becomes shorter as the humidity around the pressing roller 9 becomes higher. The relationship may be stored in a table format or as arithmetic expressions.

The attaching precoat amount determining unit 45 is configured to determine an attachment amount as an amount of the precoat liquid attaching onto the outer circumferential surface of the pressing roller 9 via the sheet P after being discharged by the precoat head 2. The attaching precoat amount determining unit 45 includes a partial attachment amount determining section 45*a*, a collision position determining section 45*b*, and an attachment amount calculating section 45*c*.

As depicted in FIG. 5, the partial attachment amount determining section 45*a* calculates, based on the image data, a partial attachment amount as an amount of the precoat liquid attaching onto each of partial areas into which the outer circumferential surface of the pressing roller 9 is sectioned with a central angle θ, and stores the calculated partial attachment amount.

Referring to the information stored in the arrival time storing unit 44, the collision position determining section 45*b* determines the standard time x corresponding to the combination of the respective values of the feeding velocity of the sheet P, the thickness of the sheet P, the material of the sheet P, and the humidity around the pressing roller 9 (i.e., the detection result of the humidity sensor 12). Further, the collision position determining section 45*b* calculates a rotational position of the pressing roller 9 against which the leading end of the sheet P in the feeding direction collides, based on the determined standard time x and a detection result of an encoder (not shown) that detects a rotational position of the pressing roller 9.

The attachment amount calculating section 45*c* weights each partial attachment amount stored in the partial attachment amount determining section 45*a*, so as to put less weight on the partial attachment amount for a partial area farther from the rotational position determined by the collision position determining section 45*b*. In addition, the attachment amount calculating section 45*c* determines an attachment amount (i.e., an amount of the precoat liquid attaching onto the outer circumferential surface of the pressing roller 9) by summating the weighted partial attachment amounts. Further, as shown in FIG. 6, the attachment amount calculating section 45*c* corrects the determined attachment amount such that the attachment amount becomes smaller as an elapsed time since the last contact between the pressing roller 9 and the sheet P onto which the precoat liquid is discharged becomes longer. Furthermore, the attachment amount calculating section 45*c* sets the attachment amount to zero when the sheet P with no precoat liquid discharged thereon contacts the pressing roller 9. The attaching precoat amount determining unit 45 determines a value corresponding to the attachment amount calculated by the attachment amount calculating section 45*c*, as an amount of the precoat liquid attaching onto the outer circumferential surface of the pressing roller 9.

Referring back to FIG. 2, the delay time storing unit 46 stores a (correspondence) relationship between the delay time Δx and each of combinations of respective values of the feeding velocity of the sheet P, the material of the sheet P, the humidity around the pressing roller 9, and the attachment amount of the precoat liquid attaching onto the outer circumferential surface of the pressing roller 9. Specifically, the delay time storing unit 46 stores a (correspondence) relationship between the delay time Δx and each combination of the above values, which relationship is adapted such that the delay time Δx becomes longer as the feeding velocity of the sheet P becomes higher, the delay time Δx becomes longer as the frictional force resulting from the material of the sheet P becomes smaller, the delay time Δx becomes shorter as the humidity around the pressing roller 9 becomes higher, and the delay time Δx becomes shorter as the attachment amount of the precoat liquid attaching onto the outer circumferential surface of the pressing roller 9 becomes larger. It is noted that as illustrated in FIG. 7, in the relationship between the attachment amount and the delay time Δx, the delay time Δx approaches a predetermined minimum value as the attachment amount rises. The relationship may be stored in a table format or as arithmetic expressions.

Referring back to FIG. 2, the sheet type storing unit 48 stores the type (e.g., a high-quality sheet, a photo sheet, etc.) of the sheet P to be conveyed by the feeding unit 20. The type of the sheet P is input by a user.

The delay time determining unit 47 determines the material of the sheet P from the type of the sheet P stored in the sheet type storing unit 48 when the attachment amount calculated by the attachment amount calculating section 45*c* is more than zero. In addition, the delay time determining unit 47 determines a value of the humidity around the pressing roller 9 that corresponds to the detection result of the humidity sensor 12. Further, referring to the information stored in the delay time storing unit 46, the delay time determining unit 47 determines the delay time Δx corresponding to the combination of the respective values of the feeding velocity of the sheet P, the material of the sheet P, the humidity around the pressing roller 9, and the attachment amount determined by the attaching precoat amount determining unit 45. Additionally, the delay time determining unit 47 sets the delay time Δx to zero when the attachment amount calculated by the attachment amount calculating section 45*c* is zero.

The head controller 42 controls the precoat head 2 to discharge a predetermined volume of droplet of the precoat liquid onto the sheet P being fed by the feeding unit 20, at a predetermined moment, based on the image data stored in the image data storing unit 41.

In addition, the head controller 42 determines the thickness and the material of the sheet P from the type of the sheet P stored in the sheet type storing unit 48. Further, the head controller 42 determines a value of the humidity around the pressing roller 9 that corresponds to the detection result of the humidity sensor 12. Then, referring to the information stored in the arrival time storing unit 44, the head controller 42 determines the standard time x corresponding to the combination of the respective values of the feeding velocity of the sheet P, the thickness of the sheet P, the material (type) of the sheet P, and the humidity around the pressing roller 9. Further, the head controller 42 calculates the arrival time t by summating the determined standard time x and the delay time Δx determined by the delay time determining unit 47. The head controller 42 controls each inkjet head 1 to discharge a predetermined volume of ink droplet at a predetermined moment, based on a reference time as a moment when the leading end of the sheet P reaches the inkjet head 1 for black after a lapse of the calculated arrival time t since the sheet sensor 11 has detected that the leading end of the sheet P being fed by the feeding unit 20 has passed just beneath the sheet sensor 11.

As described above, the inkjet printer 101 of the embodiment can determine (estimate) a delay in feeding the sheet P that would be caused in response to the leading end of the sheet P in the feeding direction being curled when colliding against the pressing roller 9, based on the information previously stored in the arrival time storing unit 44 and the delay time storing unit 46. Therefore, it is possible to exactly correct the moment when each inkjet head 1 is to discharge a droplet of ink even though there is no sensor added at a downstream side relative to the pressing roller 9 in the feeding direction.

Further, the delay time storing unit 46 stores such a (correspondence) relationship that the delay time Δx becomes shorter as the amount of the precoat liquid attaching onto the pressing roller 9 becomes larger. Hence, the delay time Δx is determined in consideration of that the bending amount of the sheet P curled when the leading end of the sheet P collides against the pressing roller 9 becomes smaller as the amount of the precoat liquid attaching onto the pressing roller 9 becomes larger. Thereby, it is possible to more exactly correct the moment when each inkjet head 1 is to discharge a droplet of ink.

Further, the attachment amount calculating section 45*c* corrects the determined attachment amount such that the attachment amount becomes smaller as the elapsed time since the last contact between the pressing roller 9 and the sheet P onto which the precoat liquid is discharged becomes longer. Hence, the delay time Δx is determined in consideration of that a substantial attachment amount (of the precoat liquid attaching onto the pressing roller 9) is reduced in response to (the outer circumferential surface of) the pressing roller 9 being dried to lose the precoat liquid staying thereon. Thereby, it is possible to accurately determine the delay time Δx.

In addition, the attachment amount calculating section 45*c* sets the attachment amount to zero when the sheet P having no precoat liquid discharged thereon contacts the pressing roller 9. Thus, it is possible to accurately determine the attachment amount in consideration of that when the sheet P with no precoat liquid discharged thereon contacts the pressing roller 9, the precoat liquid attaching onto the pressing roller 9 is transferred onto the sheet P.

Additionally, the attaching precoat amount determining unit 45 stores the partial attachment amount of the precoat liquid attaching onto each of the partial areas into which the outer circumferential surface of the pressing roller 9 is sectioned with the central angle θ. Further, the attaching precoat amount determining unit 45 puts weight on the partial attachment amount for each partial area, so as to put less weight on the partial attachment amount for a partial area farther from the determined rotational position of the pressing roller 9 against which the leading end of the sheet P in the feeding direction collides. Furthermore, the attaching precoat amount determining unit 45 determines the attachment amount by summating the weighted partial attachment amounts. Thus, since the attachment amount of the precoat liquid that has an influence on the delay time Δx is calculated, it is possible to precisely determine the delay time Δx.

Further, the head controller 42 determines the moment when each inkjet head 1 is to discharge a droplet of ink by rendering the standard time x longer as the sheet P becomes thicker. Therefore, it is possible to accurately determine the standard time x in consideration of that the bending amount of the sheet P curled when colliding against the pressing roller 9 becomes larger as the sheet P becomes thicker.

Additionally, in the embodiment, the standard time x and the delay time Δx are determined to vary depending on the material of the sheet P. Thus, it is possible to accurately determine the standard time x and the delay time Δx responsive to a frictional property resulting from the material of the sheet P.

Further, in the embodiment, the standard time x and the delay time Δx are determined to be longer in response to a higher feeding velocity for the sheet P. Thus, it is possible to more accurately determine the standard time x and the delay time Δx.

Further, in the embodiment, the standard time x and the delay time Δx are determined to be shorter in response to a higher value of the humidity around the pressing roller 9. Thus, it is possible to more accurately determine the standard time x and the delay time Δx in consideration of that the bending amount of the sheet P becomes smaller as the adhesibility of the pressing roller 9 becomes higher.

Hereinabove, the embodiment according to aspects of the present invention has been described. The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without reapportioning to the details specifically set forth. In other instances, well known processing structures have not been described in detail, in order not to unnecessarily obscure the present invention.

Only an exemplary embodiment of the present invention and but a few examples of their versatility are shown and described in the present disclosure. It is to be understood that the present invention is capable of use in various other combinations and environments and is capable of changes or modifications within the scope of the inventive concept as expressed herein. For example, the following modifications are feasible.

<Modifications>

In the aforementioned embodiment, the partial attachment amount is stored for each of the partial areas into which the outer circumferential surface of the pressing roller 9 is sectioned with the central angle θ. Further, each partial area is weighted such that less weight is put on a partial area farther from the rotational position of the pressing roller 9 against which the leading end of the sheet P in the feeding direction collides. Furthermore, the attachment amount is determined by the summation of the weighted partial attachment amounts. However, for instance, the partial attachment amount determining section 45*a* may calculate and store a partial attachment amount for each of partial areas into which the outer circumferential surface is sectioned in a matrix state. Further, the collision position determining section 45*b* may determine one or more partial areas against which the leading end of the sheet P collides. Further, the attachment amount calculating section 45*c* may determine an attachment amount as the maximum value or summation of partial attachment amounts of the precoat liquid attaching onto the one or more partial areas determined by the collision position determining section 45*b*. Alternatively, the amount of the precoat liquid attaching onto the entire outer circumferential surface of the pressing roller 9 may be determined without sectioning the outer circumferential surface into partial areas.

In the aforementioned embodiment, the attachment amount calculating section 45*c* corrects the determined attachment amount so as to make the attachment amount smaller as the elapsed time since the last contact between the pressing roller 9 and the sheet P onto which the precoat liquid is discharged becomes longer. However, the attachment amount may not be corrected depending on the elapsed time.

In the aforementioned embodiment, the attachment amount calculating section 45*c* sets the attachment amount to zero when the sheet P on which the precoat liquid is not discharged contacts the pressing roller 9. However, the attachment amount calculating section 45*c* may reduce the attachment amount to such an extent that the attachment amount is not zero. Alternatively, the attachment amount calculating section 45*c* may not reduce the attachment amount.

In the aforementioned embodiment, the delay time Δx becomes shorter as the attachment amount of the precoat liquid attaching onto the outer circumferential surface of the pressing roller 9 becomes larger. However, depending on the material of the pressing roller 9, the delay time Δx may become longer as the attachment amount becomes larger. It is noted that the relationship between the attachment amount and the delay time Δx is previously determined on an experimental basis and stored in the delay time storing unit 46.

In the aforementioned embodiment, the head controller 42 renders the standard time x longer as the sheet P becomes thicker. However, the head controller 42 may determine the standard time x in no consideration of the thickness of the sheet P.

In the aforementioned embodiment, the standard time x and the delay time Δx are changed depending on the material of the sheet P. However, only one of the standard time x and the delay time Δx may be changed depending on the material of the sheet P. Alternatively, none of the standard time x and the delay time Δx may be changed depending on the material of the sheet P.

In the aforementioned embodiment, the standard time x and the delay time Δx are changed depending on the feeding velocity for the sheet P. However, at least one of the standard time x and the delay time Δx may be unchanged against the feeding velocity.

In the aforementioned embodiment, the standard time x and the delay time Δx are changed depending on the feeding velocity for the sheet P. Specifically, responsive to a higher feeding velocity, the bending amount of the sheet P becomes larger while the arrival time t for the sheet P becomes shorter. Therefore, the standard time x and the delay time Δx are rendered shorter in response to a higher feeding velocity for the sheet P. However, the standard time x and the delay time Δx may be rendered shorter in response to a higher feeding velocity for the sheet P. It is noted that the relationship between the feeding velocity and the standard time x and the relationship between the feeding velocity and the delay time Δx are previously determined on an experimental basis and store in the arrival time storing unit 44 and the delay time storing unit 46, respectively.

In the aforementioned embodiment, the standard time x and the delay time Δx become shorter as the humidity around the pressing roller 9 becomes higher. However, at least one of the standard time x and the delay time Δx may be unchanged against the humidity around the pressing roller 9.

Aspects of the present invention may be applied to a liquid discharger configured to discharge liquid other than ink. Aspects of the present invention may be applied to not only a printer but also a facsimile machine and a copy machine. Further, the head controller 42 may control the precoat head 2 and each inkjet head 1 to discharge ink by driving heating elements of the precoat head 2 and each inkjet head 1, instead of driving actuator units of the precoat head 2 and each inkjet head 1. Influences of the precoat liquid on the ink may include agglutinating or precipitating components (such as pigment and dye) contained in the ink in a chemical reaction caused as a result of the precoat liquid mixing with the ink. Further, the influences of the precoat liquid on the ink may include agglutinating or precipitating the components (such as pigment and dye) contained in the ink without any chemical reaction between the precoat liquid and the ink. As described in the aforementioned embodiment, in general, precoat liquid for agglutinating a pigment coloring component is applied to pigment ink, and precoat liquid for precipitating a dye coloring component is applied to dye ink. However, precoat liquid may be employed that has both functions of agglutinating and precipitating a coloring component contained in ink.

What is claimed is:

1. A liquid discharger comprising:

a feeding mechanism configured to feed a sheet in a feeding direction along a feeding path;

a first discharging head configured to discharge, onto a predetermined side of the sheet being fed in the feeding direction, first liquid for forming an image on the sheet;

a second discharging head disposed upstream relative to the first discharging head in the feeding direction, the second discharging head being configured to discharge, onto the predetermined side of the sheet being fed in the feeding direction, second liquid that acts on the first liquid to agglutinate or precipitate a component contained in the first liquid;

a detector disposed upstream relative to the second discharging head in the feeding direction, the detector being configured to detect that a predetermined position of the sheet passes through a detecting point for the detector on the feeding path;

a rotary roller disposed upstream relative to the first discharging head and downstream relative to the second discharging head in the feeding direction, the rotary roller being configured to contact the predetermined side of the sheet being fed in the feeding direction;

an attachment amount determining unit configured to determine an attachment amount of the second liquid attaching onto the rotary roller via the sheet after being discharged by the second discharging head, based on an amount of the second liquid discharged by the second discharging head;

an arrival time storing unit configured to store a standard arrival time that is a time period required for the sheet to reach the first discharging head since the detector detects that the predetermined position of the sheet being fed at a predetermined feeding velocity passes through the detection point in a state where there is no second liquid attaching onto the rotary roller;

a delay time storing unit configured to store a relationship between each value of the attachment amount and a corresponding delay time to be caused when the sheet being fed at the predetermined feeding velocity passes through the rotary roller;

a delay time determining unit configured to, when the attachment amount determined by the attachment amount determining unit is more than zero, determine a delay time corresponding to the determined attachment amount based on the relationship stored in the delay time storing unit; and a controller configured to control the first discharging head and the second discharging head, the controller determining a moment when the first discharging head is to discharge the first liquid, based on a summation of the standard arrival time stored in the arrival time storing unit and the delay time determined by the delay time determining unit, wherein the attachment amount determining unit comprises:

a partial attachment amount storing section configured to store a partial attachment amount of the second liquid attaching onto each of partial areas that are defined by respective rotational positions on an outer circumferential surface of the rotary roller; and a collision position determining section configured to determine a rotational position, on the outer circumferential surface of the rotary roller, against which a leading end of the sheet in the feeding direction collides, wherein the attachment amount determined by the attachment amount determining unit contains at least a partial attachment amount, stored in the partial attachment amount storing section, of the second liquid attaching onto a partial area defined by the rotational position determined by the collision position determining section, wherein the delay time associated with each attachment amount in the relationship stored in the delay time storing unit is a single value invariable for a single sheet, and wherein the delay time determining unit is configured to determine the delay time for each sheet to be fed through the rotary roller.

2. The liquid discharger according to claim 1, wherein the delay time storing unit stores the relationship that is adapted such that the delay time becomes short as the attachment amount becomes large.

3. The liquid discharger according to claim 1, wherein the attachment amount determining unit determines the attachment amount to be smaller as an elapsed time since a last contact between the rotary roller and the sheet onto which the second liquid has been discharged becomes longer.

4. The liquid discharger according to claim 1, wherein the attachment amount determining unit sets the attachment amount to zero when the sheet onto which the second liquid has not been discharged contacts the rotary roller.

5. The liquid discharger according to claim 1, further comprising a thickness storing unit configured to store a thickness of the sheet fed by the feeding mechanism, wherein the arrival time storing unit stores a relationship between each value of the thickness of the sheet and a corresponding standard arrival time that becomes longer as the thickness of the sheet becomes larger, and wherein the controller determines the moment when the first discharging head is to discharge the first liquid, based on the summation of the delay time determined by the delay time determining unit and the standard arrival time that is determined to correspond to the thickness stored in the thickness storing unit with reference to the relationship stored in the arrival time storing unit.

6. The liquid discharger according to claim 1, further comprising a material storing unit configured to store a material of the sheet fed by the feeding mechanism, wherein the arrival time storing unit stores a relationship between each type of the material of the sheet and a corresponding standard arrival time, wherein the delay time storing unit stores a relationship between each type of the material of the sheet and a corresponding delay time, wherein the delay time determining unit determines the delay time to correspond to the attachment amount determined by the attachment amount determining unit and the material stored in the material storing unit, based on the relationships stored in the delay time storing unit, and wherein the controller determines the moment when the first discharging head is to discharge the first liquid, based on the summation of the delay time determined by the delay time determining unit and the standard arrival time that is determined to correspond to the material stored in the material storing unit with reference to the relationship stored in the arrival time storing unit.

7. The liquid discharger according to claim 1, wherein the arrival time storing unit stores a relationship between each value of the feeding velocity and a corresponding standard arrival time, wherein the delay time storing unit stores a relationship between each value of the feeding velocity and a corresponding delay time, wherein the delay time determining unit determines the delay time to correspond to the attachment amount determined by the attachment amount determining unit and the predetermined feeding velocity, based on the relationships stored in the delay time storing unit, and wherein the controller determines the moment when the first discharging head is to discharge the first liquid, based on the summation of the delay time determined by the delay time determining unit and the standard arrival time that is determined to correspond to the predetermined feeding velocity with reference to the relationship stored in the arrival time storing unit.

8. The liquid discharger according to claim 1, further comprising a humidity sensor configured to sense humidity around the rotary roller, wherein the arrival time storing unit stores a relationship between each value of the humidity and a corresponding standard arrival time that becomes shorter as the humidity becomes higher, wherein the delay time storing unit stores a relationship between each value of the humidity and a corresponding delay time that becomes shorter as the humidity becomes higher, wherein the delay time determining unit determines the delay time to correspond to the attachment amount determined by the attachment amount determining unit and the humidity sensed by the humidity sensor, based on the relationships stored in the delay time storing unit, and wherein the controller determines the moment when the first discharging head is to discharge the first liquid, based on the summation of the delay time determined by the delay time determining unit and the standard arrival time that is determined to correspond to the humidity sensed by the humidity sensor with reference to the relationship stored in the arrival time storing unit.

9. The liquid discharger according to claim 1, wherein the attachment amount determining unit further comprises:

an attachment amount calculating section configured to weight each partial attachment amount stored in the partial attachment amount storing section, so as to put less weight on a partial attachment amount of a partial area farther from the rotational position determined by the collision position determining section, and to determine the attachment amount by summating the weighted partial attachment amounts.

10. A liquid discharger comprising:

a feeding mechanism configured to feed a sheet in a feeding direction along a feeding path;

a first discharging head configured to discharge, onto a predetermined side of the sheet being fed in the feeding direction, first liquid for forming an image on the sheet;

a second discharging head disposed upstream relative to the first discharging head in the feeding direction, the second discharging head being configured to discharge, onto the predetermined side of the sheet being fed in the feeding direction, second liquid that acts on the first liquid to agglutinate or precipitate a component contained in the first liquid;

a detector disposed upstream relative to the second discharging head in the feeding direction, the detector being configured to detect that a predetermined position of the sheet passes through a detecting point for the detector on the feeding path;

a rotary roller disposed upstream relative to the first discharging head and downstream relative to the second discharging head in the feeding direction, the rotary roller being configured to contact the predetermined side of the sheet being fed in the feeding direction;

an attachment amount determining unit configured to determine an attachment amount of the second liquid attaching onto the rotary roller via the sheet after being discharged by the second discharging head, based on an amount of the second liquid discharged by the second discharging head;

an arrival time storing unit configured to store a standard arrival time that is a time period required for the sheet to reach the first discharging head since the detector detects that the predetermined position of the sheet being fed at a predetermined feeding velocity passes through the detection point in a state where there is no second liquid attaching onto the rotary roller;

a delay time storing unit configured to store a relationship between each value of the attachment amount and a corresponding delay time to be caused when the sheet being fed at the predetermined feeding velocity passes through the rotary roller;

a delay time determining unit configured to, when the attachment amount determined by the attachment amount determining unit is more than zero, determine a delay time corresponding to the determined attachment amount based on the relationship stored in the delay time storing unit; and a controller configured to control the first discharging head and the second discharging head, the controller determining a moment when the first discharging head is to discharge the first liquid, based on a summation of the standard arrival time stored in the arrival time storing unit and the delay time determined by the delay time determining unit, wherein the attachment amount determining unit comprises:

a partial attachment amount storing section configured to store a partial attachment amount of the second liquid attaching onto each of partial areas into which an outer circumferential surface of the rotary roller is sectioned in a matrix state;

a collision area determining section configured to determine one or more partial areas against which a leading end of the sheet in the feeding direction collides; and an attachment amount calculating section configured to determine the attachment amount as a maximum value of partial attachment amounts of the one or more partial areas determined by the collision area determining section.

11. An image forming apparatus configured to form an image on a sheet while discharging first liquid onto the sheet, comprising a liquid discharger that comprises:

a feeding mechanism configured to feed the sheet in a feeding direction along a feeding path;

a first discharging head configured to discharge the first liquid onto a predetermined side of the sheet being fed in the feeding direction;

a second discharging head disposed upstream relative to the first discharging head in the feeding direction, the second discharging head being configured to discharge, onto the predetermined side of the sheet being fed in the feeding direction, second liquid that acts on the first liquid to agglutinate or precipitate a component contained in the first liquid;

a detector disposed upstream relative to the second discharging head in the feeding direction, the detector being configured to detect that a predetermined position of the sheet passes through a detecting point for the detector on the feeding path;

a rotary roller disposed upstream relative to the first discharging head and downstream relative to the second discharging head in the feeding direction, the rotary roller being configured to contact the predetermined side of the sheet being fed in the feeding direction;

an attachment amount determining unit configured to determine an attachment amount of the second liquid attaching onto the rotary roller via the sheet after being discharged by the second discharging head, based on an amount of the second liquid discharged by the second discharging head;

an arrival time storing unit configured to store a standard arrival time that is a time period required for the sheet to reach the first discharging head since the detector detects that the predetermined position of the sheet being fed at a predetermined feeding velocity passes through the detection point in a state where there is no second liquid attaching onto the rotary roller;

a delay time storing unit configured to store a relationship between each value of the attachment amount and a corresponding delay time to be caused when the sheet being fed at the predetermined feeding velocity passes through the rotary roller;

a delay time determining unit configured to, when the attachment amount determined by the attachment amount determining unit is more than zero, determine a delay time corresponding to the determined attachment amount based on the relationship stored in the delay time storing unit; and a controller configured to control the first discharging head and the second discharging head, the controller determining a moment when the first discharging head is to discharge the first liquid, based on a summation of the standard arrival time stored in the arrival time storing unit and the delay time determined by the delay time determining unit, wherein the attachment amount determining unit comprises:

a partial attachment amount storing section configured to store a partial attachment amount of the second liquid attaching onto each of partial areas that are defined by respective rotational positions on an outer circumferential surface of the rotary roller; and a collision position determining section configured to determine a rotational position, on the outer circumferential surface of the rotary roller, against which a leading end of the sheet in the feeding direction collides, wherein the attachment amount determined by the attachment amount determining unit contains at least a partial attachment amount, stored in the partial attachment amount storing section, of the second liquid attaching onto a partial area defined by the rotational position determined by the collision position determining section, wherein the delay time associated with each attachment amount in the relationship stored in the delay time storing unit is a single value invariable for a single sheet, and wherein the delay time determining unit is configured to determine the delay time for each sheet to be fed through the rotary roller.

12. The image forming apparatus according to claim 11, wherein the delay time storing unit stores the relationship that is adapted such that the delay time becomes short as the attachment amount becomes large.

13. The image forming apparatus according to claim 11, wherein the attachment amount determining unit determines the attachment amount to be smaller as an elapsed time since a last contact between the rotary roller and the sheet onto which the second liquid has been discharged becomes longer.

14. The image forming apparatus according to claim 11, wherein the attachment amount determining unit sets the attachment amount to zero when the sheet onto which the second liquid has not been discharged contacts the rotary roller.

15. The image forming apparatus according to claim 11, wherein the liquid discharger further comprises a thickness storing unit configured to store a thickness of the sheet fed by the feeding mechanism, wherein the arrival time storing unit stores a relationship between each value of the thickness of the sheet and a corresponding standard arrival time that becomes longer as the thickness of the sheet becomes larger, and wherein the controller determines the moment when the first discharging head is to discharge the first liquid, based on the summation of the delay time determined by the delay time determining unit and the standard arrival time that is determined to correspond to the thickness stored in the thickness storing unit with reference to the relationship stored in the arrival time storing unit.

16. The image forming apparatus according to claim 11, wherein the liquid discharger further comprises a material storing unit configured to store a material of the sheet fed by the feeding mechanism, wherein the arrival time storing unit stores a relationship between each type of the material of the sheet and a corresponding standard arrival time, wherein the delay time storing unit stores a relationship between each type of the material of the sheet and a corresponding delay time, wherein the delay time determining unit determines the delay time to correspond to the attachment amount determined by the attachment amount determining unit and the material stored in the material storing unit, based on the relationships stored in the delay time storing unit, and wherein the controller determines the moment when the first discharging head is to discharge the first liquid, based on the summation of the delay time determined by the delay time determining unit and the standard arrival time that is determined to correspond to the material stored in the material storing unit with reference to the relationship stored in the arrival time storing unit.

17. The image forming apparatus according to claim 11, wherein the arrival time storing unit stores a relationship between each value of the feeding velocity and a corresponding standard arrival time, wherein the delay time storing unit stores a relationship between each value of the feeding velocity and a corresponding delay time, wherein the delay time determining unit determines the delay time to correspond to the attachment amount determined by the attachment amount determining unit and the predetermined feeding velocity, based on the relationships stored in the delay time storing unit, and wherein the controller determines the moment when the first discharging head is to discharge the first liquid, based on the summation of the delay time determined by the delay time determining unit and the standard arrival time that is determined to correspond to the feeding velocity with reference to the relationship stored in the arrival time storing unit.

18. The image forming apparatus according to claim 11, wherein the liquid discharger further comprises a humidity sensor configured to sense humidity around the rotary roller, wherein the arrival time storing unit stores a relationship between each value of the humidity and a corresponding standard arrival time that becomes shorter as the humidity becomes higher, wherein the delay time storing unit stores a relationship between each value of the humidity and a corresponding delay time that becomes shorter as the humidity becomes higher, wherein the delay time determining unit determines the delay time corresponding to the attachment amount determined by the attachment amount determining unit and the humidity sensed by the humidity sensor, based on the relationships stored in the delay time storing unit, and wherein the controller determines the moment when the first discharging head is to discharge the first liquid, based on the summation of the delay time determined by the delay time determining unit and the standard arrival time that is determined to correspond to the humidity sensed by the humidity sensor with reference to the relationship stored in the arrival time storing unit.

19. The image forming apparatus according to claim 11, wherein the attachment amount determining unit further comprises:

an attachment amount calculating section configured to weight each partial attachment amount stored in the partial attachment amount storing section, so as to put less weight on a partial attachment amount of a partial area farther from the rotational position determined by the collision position determining section, and to determine the attachment amount by summating the weighted partial attachment amounts.

20. An image forming apparatus configured to form an image on a sheet while discharging first liquid onto the sheet, comprising a liquid discharger that comprises:

a feeding mechanism configured to feed the sheet in a feeding direction along a feeding path;

a first discharging head configured to discharge the first liquid onto a predetermined side of the sheet being fed in the feeding direction;

a second discharging head disposed upstream relative to the first discharging head in the feeding direction, the second discharging head being configured to discharge, onto the predetermined side of the sheet being fed in the feeding direction, second liquid that acts on the first liquid to agglutinate or precipitate a component contained in the first liquid;

a detector disposed upstream relative to the second discharging head in the feeding direction, the detector being configured to detect that a predetermined position of the sheet passes through a detecting point for the detector on the feeding path;

a rotary roller disposed upstream relative to the first discharging head and downstream relative to the second discharging head in the feeding direction, the rotary roller being configured to contact the predetermined side of the sheet being fed in the feeding direction;

an attachment amount determining unit configured to determine an attachment amount of the second liquid attaching onto the rotary roller via the sheet after being discharged by the second discharging head, based on an amount of the second liquid discharged by the second discharging head;

an arrival time storing unit configured to store a standard arrival time that is a time period required for the sheet to reach the first discharging head since the detector detects that the predetermined position of the sheet being fed at a predetermined feeding velocity passes through the detection point in a state where there is no second liquid attaching onto the rotary roller;

a delay time storing unit configured to store a relationship between each value of the attachment amount and a corresponding delay time to be caused when the sheet being fed at the predetermined feeding velocity passes through the rotary roller;

a delay time determining unit configured to, when the attachment amount determined by the attachment amount determining unit is more than zero, determine a delay time corresponding to the determined attachment amount based on the relationship stored in the delay time storing unit; and a controller configured to control the first discharging head and the second discharging head, the controller determining a moment when the first discharging head is to discharge the first liquid, based on a summation of the standard arrival time stored in the arrival time storing unit and the delay time determined by the delay time determining unit wherein the attachment amount determining unit comprises:

a partial attachment amount storing section configured to store a partial attachment amount of the second liquid attaching onto each of partial areas into which an outer circumferential surface of the rotary roller is sectioned in a matrix state;

a collision area determining section configured to determine one or more partial areas against which a leading end of the sheet in the feeding direction collides; and an attachment amount calculating section configured to determine the attachment amount as a maximum value of partial attachment amounts of the one or more partial areas determined by the collision area determining section.

* * * * *